US011465874B2

(12) United States Patent
Pettersson

(10) Patent No.: US 11,465,874 B2
(45) Date of Patent: Oct. 11, 2022

(54) VACUUM WHEEL FANFOLD STACKER AND METHODS FOR USE THEREOF

(71) Applicant: Packsize LLC, Salt Lake City, UT (US)

(72) Inventor: Niklas Pettersson, Vasteras (SE)

(73) Assignee: PACKSIZE LLC, Salt Lake City, UT (US)

( * ) Notice: Subject to any disclaimer, the term of this patent is extended or adjusted under 35 U.S.C. 154(b) by 70 days.

(21) Appl. No.: 17/179,201

(22) Filed: Feb. 18, 2021

(65) Prior Publication Data

US 2021/0171311 A1 Jun. 10, 2021

Related U.S. Application Data

(63) Continuation-in-part of application No. 15/770,864, filed as application No. PCT/US2016/059220 on Oct. 27, 2016, now Pat. No. 10,954,096.

(60) Provisional application No. 62/247,083, filed on Oct. 27, 2015.

(51) Int. Cl.
*B65H 45/101* (2006.01)
*B65H 31/10* (2006.01)

(52) U.S. Cl.
CPC ..... *B65H 45/1015* (2013.01); *B65H 31/10* (2013.01); *B65H 2406/3454* (2013.01); *B65H 2406/365* (2013.01); *B65H 2701/11231* (2013.01); *B65H 2701/1762* (2013.01)

(58) Field of Classification Search
CPC ..... B65H 31/10; B65H 45/1015; B65H 2406/3454; B65H 2406/365; B65H 2701/11231; B65H 2701/176; B65H 2701/1762
USPC ..... 493/454
See application file for complete search history.

(56) References Cited

U.S. PATENT DOCUMENTS

| | | | |
|---|---|---|---|
| 3,735,975 | A | 5/1973 | Sukel et al. |
| 3,991,994 | A | 11/1976 | Greggs |
| 4,494,741 | A | 1/1985 | Fischer et al. |
| 4,500,082 | A | 2/1985 | Izume |
| 5,029,828 | A | 7/1991 | Sato et al. |

(Continued)

FOREIGN PATENT DOCUMENTS

| | | | |
|---|---|---|---|
| CN | 201545540 | U | 8/2010 |
| CN | 203173594 | U | 9/2013 |

(Continued)

OTHER PUBLICATIONS

Final Office Action received for U.S. Appl. No. 15/770,864, dated Jun. 12, 2020, 18 pages.

(Continued)

*Primary Examiner* — Anna K Kinsaul
*Assistant Examiner* — Himchan Song
(74) *Attorney, Agent, or Firm* — Workman Nydegger

(57) ABSTRACT

Systems and methods for folding and stacking fanfold corrugated board material. A system may include a rotatable member (e.g., a wheel) having a number of head pieces disposed thereon. Each head piece has a vacuum setting that can be used to pick up a portion of a length of fanfold and hold it while the rotatable member rotates around its axis and a second blower setting that blows the portion of the length of fanfold that was picked up and rotated around the rotatable member down onto a stack of fanfold. Such a system is capable of forming regular and consistent stacks of fanfold material efficiently and cost effectively without the need for significant human intervention.

20 Claims, 18 Drawing Sheets

(56) References Cited

U.S. PATENT DOCUMENTS

| | | | |
|---|---|---|---|
| 6,398,704 | B1 | 6/2002 | Shibuya et al. |
| 6,458,065 | B1 | 10/2002 | Niedermeyer |
| 2001/0000172 | A1 | 4/2001 | Barrus et al. |
| 2002/0144924 | A1 | 10/2002 | Johnson et al. |
| 2006/0051652 | A1 | 3/2006 | Samuels |
| 2011/0071010 | A1 | 3/2011 | Lien et al. |
| 2018/0312365 | A1 | 11/2018 | Pettersson |

FOREIGN PATENT DOCUMENTS

| | | | |
|---|---|---|---|
| DE | 0502976 | C | 7/1930 |
| DE | 0636666 | C | 10/1936 |
| DE | 1145534 | B | 3/1963 |
| DE | 3427525 | A1 | 2/1986 |
| EP | 1065162 | A2 | 1/2001 |
| EP | 1918235 | A2 | 5/2008 |
| EP | 1985564 | A2 | 10/2008 |
| IT | BO20080167 | A1 | 9/2009 |
| JP | 55-044421 | A | 3/1980 |
| JP | 59-203065 | A | 11/1984 |
| JP | 2527347 | B2 | 8/1996 |
| SU | 137497 | A1 | 11/1960 |

OTHER PUBLICATIONS

International Search Report and Written Opinion, United States International Search Authority, completed Dec. 19, 2016 completed, PCT/US2016/059220.

VACUUM WHEEL FANFOLD STACKER AND METHODS FOR USE THEREOF

CROSS-REFERENCE TO RELATED APPLICATIONS

This application is a continuation of U.S. application Ser. No. 15/770,864, filed on Apr. 25, 2018, and entitled VACUUM WHEEL FANFOLD STACKER AND METHODS FOR USE THEREOF, which is a 371 national stage application of International Application No. PCT/US2016/059220, filed Oct. 27, 2016, and entitled VACUUM WHEEL FANFOLD STACKER AND METHODS FOR USE THEREOF, which claims the benefit of, and priority to, U.S. Provisional Application No. 62/247,083, filed Oct. 27, 2015, and entitled VACUUM WHEEL FANFOLD STACKER AND METHODS FOR USE THEREOF. Each of the foregoing applications is incorporated herein by reference in its entirety.

BACKGROUND

1. Technical Field

Exemplary embodiments of the invention relate to the folding and stacking of objects, and more particularly to the folding and stacking of packaging materials. Still more particularly, embodiments relate to stacking of packaging materials, such as packaging and box materials formed of corrugated board.

2. The Relevant Technology

The automating of processes has long been a goal of industrialized society, and in virtually any industry in which a product is produced, some type of automated process is likely to be used. Oftentimes, the automated process may make use of modern technological advances that are combined into one or more automated machines that perform functions used to produce a product. The product produced by the automated machine may itself make use of raw materials. Such materials may themselves be loaded, provided, or otherwise introduced into the automated machine using an automated process, or such loading may be manual. Particularly where the loading is performed using an automated process, the raw materials may be positioned near the machine to facilitate loading.

The packaging industry is one example industry that has benefited greatly in recent years from the use of automated technology. For instance, boxes and other types of packaging may be formed out of paper-based products (e.g., corrugated board), and an automated converting machine may be programmed to use one or more available tools to perform a number of different functions on the corrugated board. When loaded into the converting machine, the corrugated board may be cut, scored, perforated, creased, folded, taped, or otherwise manipulated to form a box of virtually any shape and size, or formed into a template that may later be assembled into a box. In effect, the converting machine starts with a raw form of corrugated board (e.g., fanfold corrugated board in one or more separate feed paths) and converts the raw form into a template form that may then be assembled into a box or other type of package. When one such shape is produced, the completed product can then be stacked with other similarly configured products to await shipment or use. For example, when a box is needed, a user may then take one of the packaging templates from the stack and fold it according to the formed scores, perforations, creases, etc.

To ease shipment and storage of the packaging materials, it has been found useful to stack the packaging material (e.g., fanfold corrugated board) until such time as it is needed for use or for shipment to an end-user. In that regard, one or more individuals may be positioned at the output end of a machine that produces the desired fanfold. When the produced fanfold corrugated board product is released from the machine, those individuals may then fold the fanfold material in a fan-like fashion to form a compact stack. Notably, such use therefore often necessitates that an individual be stationed at the machine and engage in repetitive movements. In some cases, there may be injuries that result due to an accident involving the production machine, or due to the repetitive nature of the individual's movements. It would therefore be desirable to effectively stack materials with reduced human-labor and/or medical costs.

In other cases, the production machine may output the product for automated stacking. For instance, as a form of automated stacking, a robotic arm may replace the individual. In such a case, the robotic arm can be programmed to move towards the output end of the machine at the time the product is output. The arm can move into engagement with the product. The robotic arm can then fold the material in a fan-like fashion. Robotic arms can, therefore, also effectively stack materials. Such arms may, however, be complex to manufacture and/or program, such that it would be desirable for a simplified system for reliably and effectively stacking materials. Another challenge with such mechanical arms is being able to move them away from the folded material quickly enough to allow the material to fold onto itself without the mechanical arm being caught between folded layers.

Accordingly, there exists a need for alternative folding and stacking systems that are more efficient, less costly, less likely to damage the fanfold material, less likely to result in worker injury, and which are less prone to downtime and delay.

The foregoing description related to folding and stacking of corrugated board is merely exemplary, and it will be appreciated that any number of other products made from metallic, ceramic, polymeric, organic, or other materials can also be produced and it may be desirable to stack or otherwise arrange such materials in a manner similar to that described above for corrugated board products.

BRIEF SUMMARY

Exemplary embodiments of the disclosure relate to the folding and stacking of linearized fanfold corrugated board material and similar continuous or semi-continuous packaging materials. More particularly, linearized fanfold material may be folded and stacked by a system that includes a rotatable member (e.g., a wheel) having a number of head pieces disposed on the rotatable member. Each head piece has a vacuum setting that can be used to pick up a portion of a length of fanfold and hold it while the rotatable member rotates around its axis and an optional second blower setting that blows the portion of the length of fanfold that was picked up and rotated around the rotatable member down onto a stack of fanfold. Such a system is capable of forming regular and consistent stacks of fanfold material efficiently and cost effectively without the need for significant human intervention. Likewise, the folding and stacking systems and methods described herein are able to efficiently fold and stack fanfold material using mechanisms that are much less complex and less costly as compared to industrial robots and the like.

In one embodiment, a system for folding and stacking fanfold material is described. The system includes a rotatable member having at least two head pieces disposed on the rotatable member circumferentially offset from one another. The rotatable member is rotatable about an axis (e.g., a central axis). Each head piece positioned on the rotatable member has a first vacuum setting configured to engage a portion of a length of scored or creased fanfold material so as to rotate it around the axis and a second blower setting configured to blow the portion of the length of scored or creased fanfold material away from the rotatable member at a predetermined position around the axis so as to form a stack of folded fanfold material.

In one embodiment, another system for folding and stacking fanfold material includes a conveyor having a first end and a second end. The conveyor may be configured to convey a first end of a length of a fanfold material from the first end of the conveyor to the second end of the conveyor. A rotatable member may be positioned adjacent to the second end of the conveyor. The rotatable member may be rotatable about an axis such that the rotatable member can receive the fanfold material from the second end of the conveyor and rotate the fanfold material at least partially about the axis of the rotatable member. The rotatable member may have at least two head pieces disposed thereon and which are circumferentially offset from one another.

The system may also include a hopper positioned adjacent to the rotatable member and opposite the second end of the conveyor such that the hopper can receive folded fanfold material delivered by the rotatable member. In some embodiments, the hopper can be configured to be removably attached to a shipping pallet or a similar article designed for storing and shipping a stack of fanfold. In some embodiments, the hopper may include a mechanism, such as an elevator component, that maintains the top of the stack of folded fanfold material at a generally constant height or vertical position as additional layers of fanfold material are added to the stack. Thus, for instance, the elevator mechanism may lower the stack of fanfold material as additional layers of material are added to the stack in order to maintain the top of the stack at a relatively constant height or vertical position. In some embodiments, maintaining a relatively constant height or vertical position of the top of the stack can reduce or eliminate the need for the head piece(s) to adjust the location(s) where the fanfold material is released therefrom.

As with the previously described embodiment, each head piece positioned on the rotatable member can have a first vacuum setting configured to engage a portion of a length of scored or creased fanfold material so as to rotate it around the axis and a second blower setting configured to blow the portion of the length of scored or creased fanfold material away from the rotatable member at a predetermined position around the axis so as to form a stack of folded fanfold material.

In yet another embodiment, a method for folding and stacking fanfold material is described. The method includes (i) delivering a first end of a length of a fanfold material to a rotatable member having at least two head pieces disposed on the rotatable member and which are circumferentially offset from one another, (ii) rotating the rotatable member about a central axis while simultaneously continuing to deliver the fanfold material to the rotatable member, (iii) engaging a portion of the length of scored or creased fanfold material by vacuum with a first head piece so as to rotate the portion of the length of scored or creased fanfold material around the central axis, and (iv) switching the first head piece to a blower setting at a predetermined position around the axis so as to blow the portion of the length of scored or creased fanfold material away from the rotatable member so as to form a stack of folded fanfold material. In one embodiment, the method further includes (v) stacking the stack of folded fanfold material in a hopper positioned adjacent to the rotatable member.

These and other objects and features of the present disclosure will become more fully apparent from the following description and appended claims, or may be learned by the practice of the embodiments of the invention as set forth hereinafter.

BRIEF DESCRIPTION OF THE DRAWINGS

To further clarify the above and other advantages and features of the present disclosure, a more particular description of the specific embodiments will be rendered by reference to the appended drawings. It is appreciated that these drawings depict only illustrated embodiments of the disclosure and are therefore not to be considered limiting of its scope. The embodiments will be described and explained with additional specificity and detail through the use of the accompanying drawings in which.

DETAILED DESCRIPTION

Figure 1:
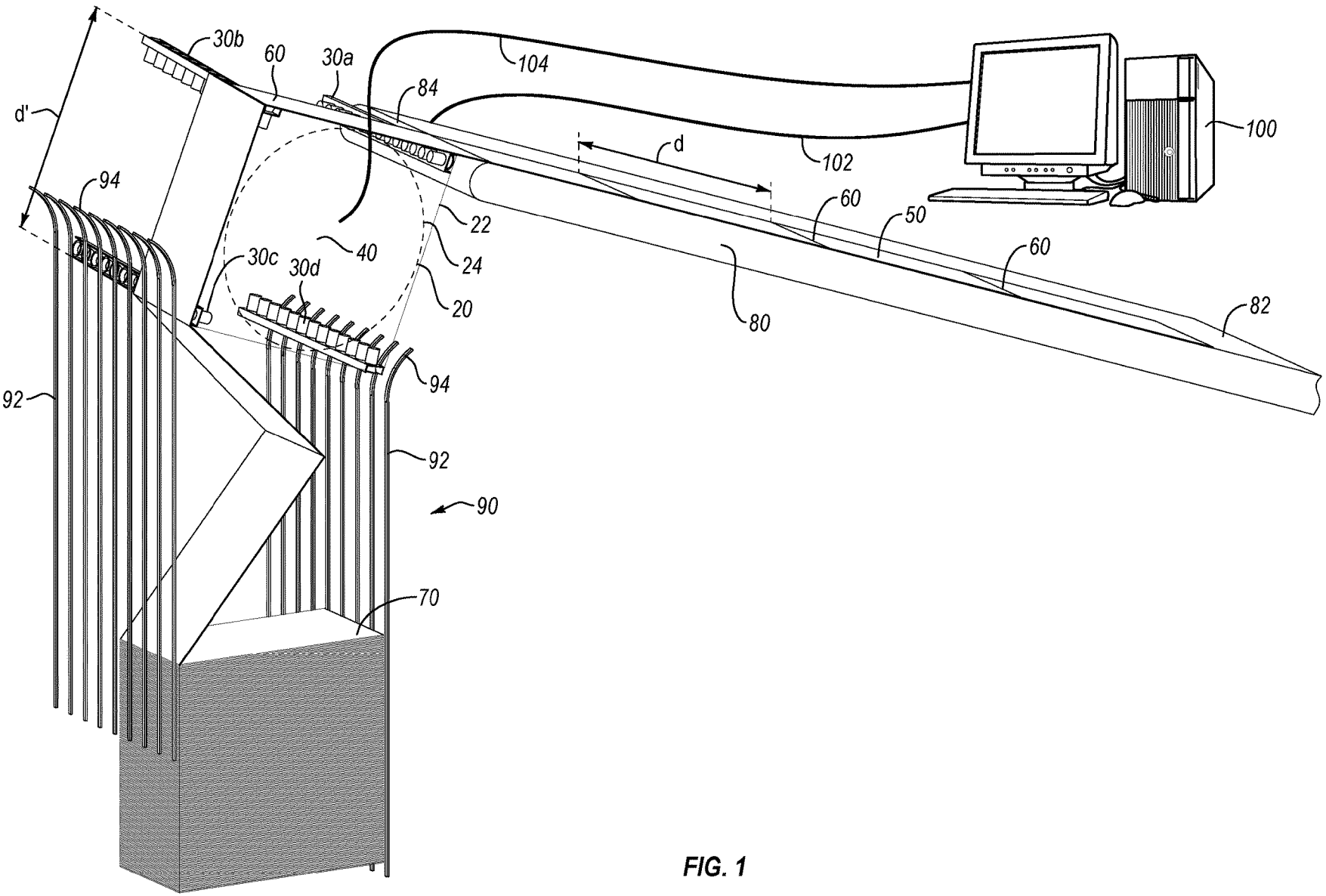
FIG. 1 illustrates a perspective view of a vacuum wheel fanfold stacker, according to an exemplary embodiment of the present disclosure.

Exemplary embodiments of the disclosure relate to the folding and stacking of linearized fanfold corrugated board material and similar continuous or semi-continuous packaging materials. More particularly, linearized fanfold material may be folded and stacked by a system that includes a rotatable member (e.g., a wheel) having a number of head pieces disposed on the rotatable member. Each head piece has a vacuum setting that can be used to pick up a portion of a length of fanfold and hold it while the rotatable member rotates around its axis and an optional second blower setting that blows the portion of the length of fanfold that was picked up and rotated around the rotatable member down onto a stack of fanfold. In some embodiments, the blower setting is activated after the vacuum setting is deactivated. Such a system is capable of forming regular and consistent stacks of fanfold material efficiently and cost effectively without the need for significant human intervention. Likewise, the folding and stacking systems and methods described herein are able to efficiently fold and stack fanfold material using mechanisms that are much less complex and less costly as compared to industrial robots and the like.

As used herein, the term "fanfold" is used to refer to any type of packaging or other type of material that is manufactured in long sheets that are folded into relatively compact stacks in a fan-like or accordion-like fashion. In one example, fanfold is a corrugated cardboard material; however, other packing materials such as paperboard can be manufactured as fanfold material. Typical corrugated fanfold packaging material is produced in single and double wall corrugated fashions, which are available in most liner grades. Typical widths of commercially available fanfold range from about 12 inches (about 30 cm) to about 98 inches (about 250 cm or 2.5 meters). Typical fold lengths range from about 20 inches (about 50 cm) to about 90 inches (about 230 cm), and are commonly about 40 inches (about 100 cm). Depending on customer needs, fanfold may also include a variety of intermediate scoring designs, coatings, printing, and the like. A single, continuous sheet of fanfold can exceed about 2300 linear feet (about 700 meters) in length. Fanfold is typically folded to fit on top of a pallet or slip sheet.

Further, as used herein, the term "packaging materials" is utilized herein to generically describe a variety of different types of materials that may be converted using a converting machine. In particular, "packaging materials" may be used to effectively refer to any material that can be converted from a raw form into a usable product, or into a template for a usable product. For instance, paper-based materials such as cardboard, corrugated board, paper board, and the like may be considered "packaging materials" although the term is not necessarily so limited. Accordingly, while examples herein describe the use of corrugated board and fanfold corrugated board, such are merely exemplary and not necessarily limiting of the present application.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Further, numerical data may also be expressed or presented herein. It is to be understood that such numerical data is used merely to illustrate example operative embodiments. Moreover, numerical data provided in range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. Furthermore, such numerical values and ranges are intended to be non-limiting examples of example embodiments, and should not be construed as required for all embodiments unless explicitly recited as such in the claims.

Reference will now be made to the drawings to describe various aspects of exemplary embodiments of the invention. It is understood that the drawings are diagrammatic and schematic representations of such exemplary embodiments, and are not limiting of the present disclosure, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present disclosure. It will be obvious, however, to one of ordinary skill in the art that embodiments of the present disclosure may be practiced without these specific details. In other cases, well known aspects of fanfold materials, conveyor systems, pneumatic systems, as well as methods and general manufacturing techniques are not described in detail herein in order to avoid unnecessarily obscuring the novel aspects of the present disclosure.

Figure 2:
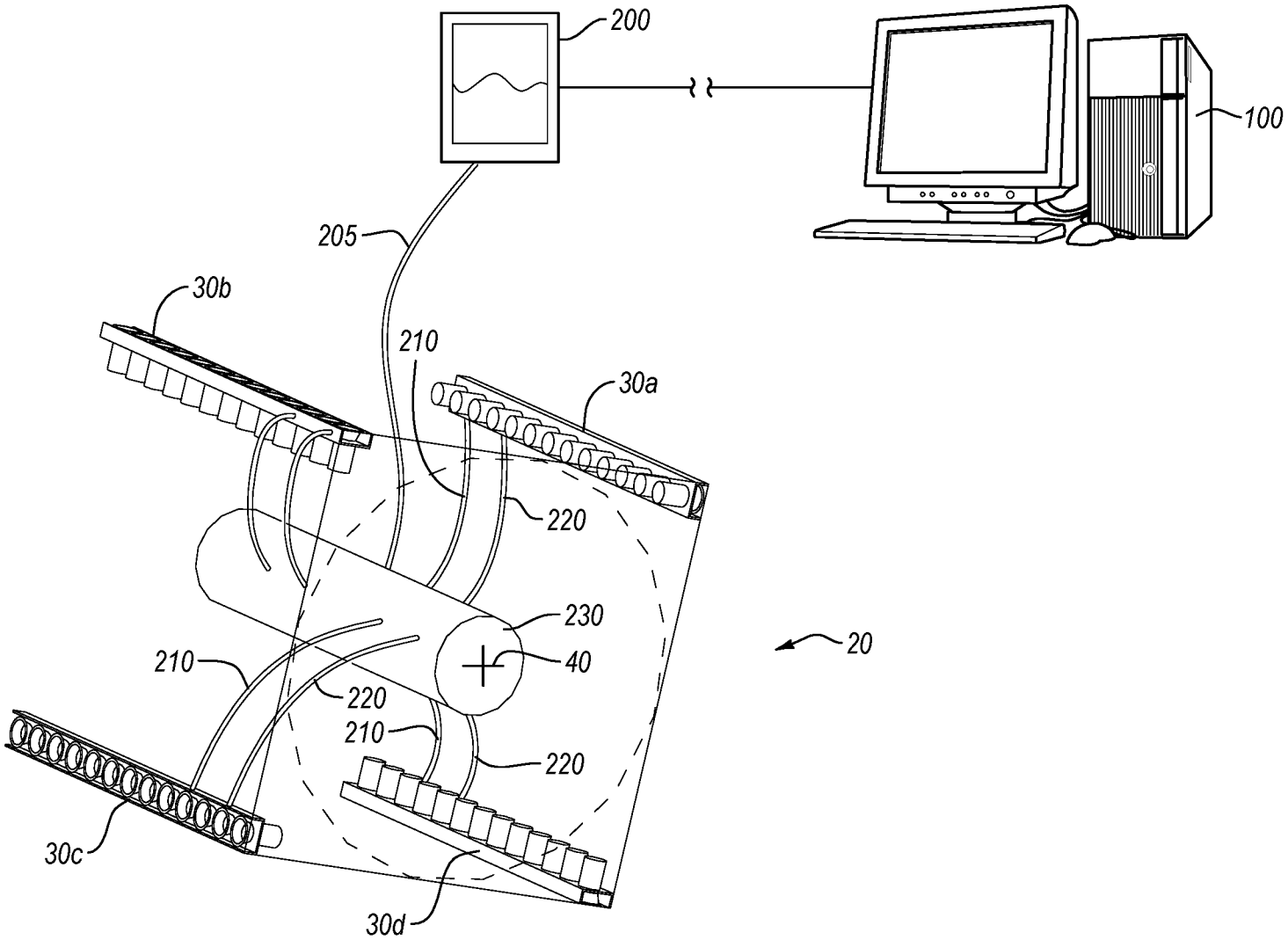
FIG. 2 illustrates a perspective view of a rotatable member having a pneumatic control system, according to an exemplary embodiment of the present disclosure.
Figure 3:
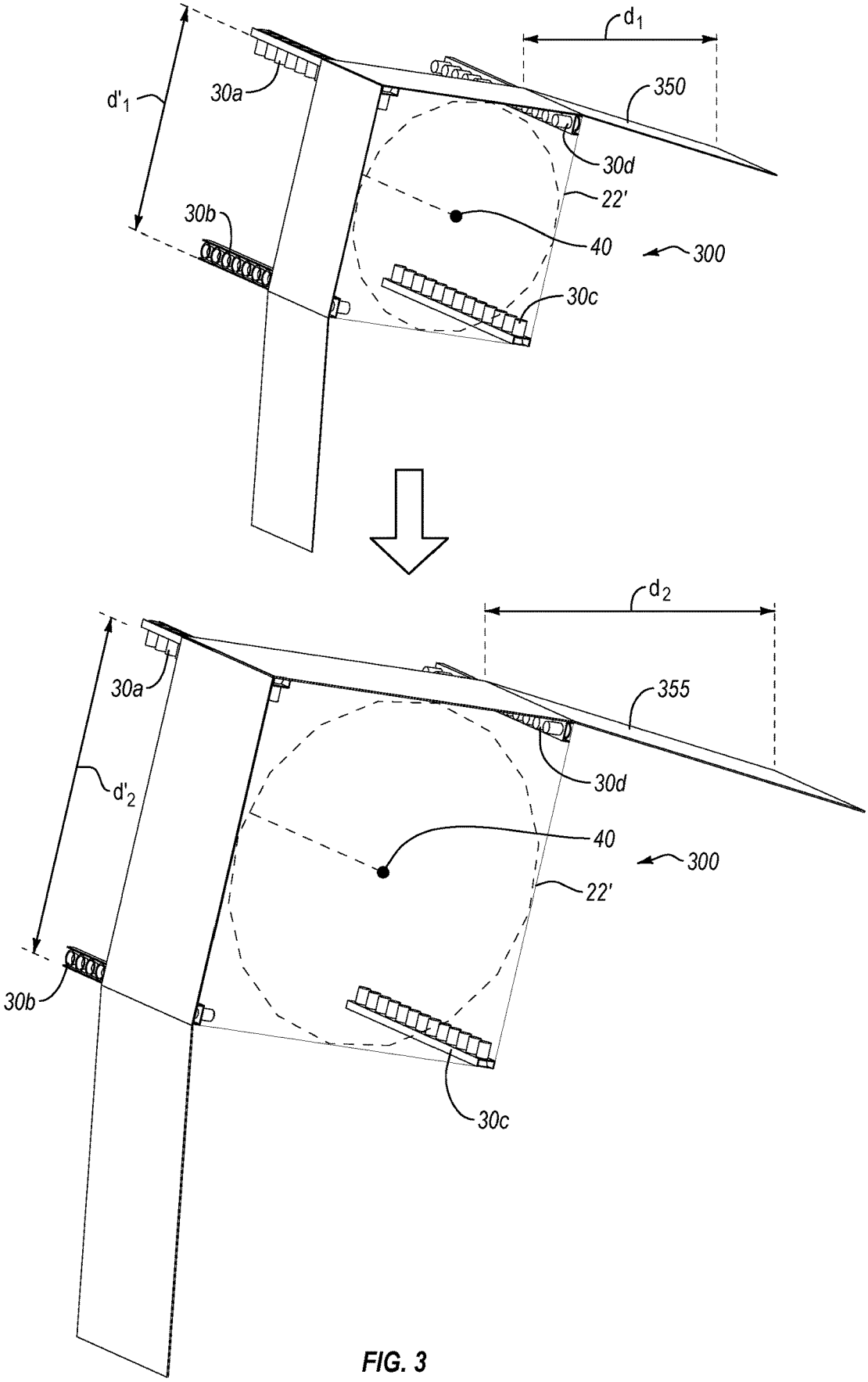
FIG. 3 illustrates a perspective view of an expandable rotatable member that can accommodate fanfold material having different inter-score distances, according to an exemplary embodiment of the present disclosure.

FIGS. 1-3 and the following discussion are intended to provide a brief general description of exemplary devices in which embodiments of the disclosure may be implemented. While a vacuum wheel fanfold stacker system for folding and stacking fanfold materials is described below, this is but one single example, and embodiments of the disclosure may be implemented with other types of materials. Accordingly, throughout the specification and claims, the phrases "fanfold material," "fanfold stack," and "fanfold" and the like are intended to apply broadly to any type of item that can be folded and stacked by the vacuum wheel fanfold stacker system described herein.

FIGS. 1-3 thus illustrate one example of a vacuum wheel fanfold stacker system implementing some aspects of the present disclosure. The vacuum wheel fanfold stacker system in FIGS. 1-3 is only one example of a suitable system and is not intended to suggest any limitation as to the scope of use or functionality of an embodiment of the disclosure. Neither should the system be interpreted as having any dependency or requirement relating to any one or combination of components illustrated in the system.

The exemplary vacuum wheel fanfold stacker system is broadly illustrated to include a rotatable member 20 having a plurality of head pieces 30*a*-30*d* circumferentially attached thereto. In the illustrated embodiment, the vacuum wheel fanfold stacker system further includes a conveyor 80, a hopper 90, and, optionally, an electronic control system shown schematically at 100. The conveyor 80 includes a first end 82 and a second end 84.

In the illustrated embodiment, the rotatable member 20 includes a box-shaped frame 22 that has a generally square profile. The box-shaped frame 22 is disposed on a round wheel 24. For example, box-shaped frame 22 may be configured such that the rotatable member 20 can support fanfold material 50 as it engages with the rotatable member 20. In other embodiments, the box-shaped frame of the rotatable member may have other profiles such as, but not limited to, round, triangular, hexagonal, star-shaped, and the like.

In the illustrated embodiment, the rotatable member 20 includes four head pieces 30*a*-30*d*. In other embodiments, the rotatable member 20 may, for example, include one, two, three, or more than four head pieces. In addition, in the illustrated embodiment, the head pieces 30*a*-30*d* are positioned at the corners of the box-shaped frame 22 of the rotatable member 20. In other embodiments, the rotatable member 20 may, for example, include head pieces at one or more intermediate positions between the corners of the box-shaped frame 22 of the rotatable member 20, such midway between of the corners of the box-shaped frame 22.

In the illustrated embodiment, linear fanfold material 50 is conveyed by the conveyor 80 from the first end 82 to the second end 84 where it is picked up by the rotatable member 20. The linear fanfold material 50 is then rotated around the rotatable member 20 and folded into the hopper 90 to form a fanfold stack 70. In the illustrated embodiment, the fanfold material 50 is corrugated board material having a number of crease lines or score marks 60 separated by distance d. In the illustrated embodiment, the plurality of head pieces 30*a*-30*d* on the rotatable member 20 are spaced apart by distance d', which is substantially equal to distance d in the illustrated embodiment, such that the rotatable member 20 can engage with a portion of linear fanfold material 50 of length d between creases 60 without creating additional creases in the fanfold material 50 as the rotatable member 20 rotates about its axis 40. In other embodiments, the distance d' is a multiple of distance d, such that the rotatable member 20 can engage and only fold the fanfold material 50 at non-sequential creases 60.

As the rotatable member 20 rotates about its axis 40, some of the head pieces 30*a*-30*d* will become positioned such that they can pneumatically engage with the fanfold material 50 by vacuum. In the embodiment illustrated in FIG. 1, head pieces 30*b* and 30*c* are pneumatically engaged with the fanfold material 50. As the rotatable member 20 rotates about its axis 40, the pneumatically engaged head pieces hold onto the fanfold and rotate it about axis 40. At a selected point on the rotation path of the rotatable member 20, the engaged head pieces (e.g., 30*b* and 30*c*) can turn off the vacuum setting, thereby disengaging the head pieces from the fanfold material 50 and allowing the fanfold material 50 to descend onto the fanfold stack 70.

Optionally, after the vacuum setting is turned off, a blower setting may be activated to cause the head pieces to blow the linear fanfold material 50 down onto the fanfold stack 70. Blowing the fanfold material 50 down onto the stack 70 as opposed to allowing it to fall by gravity alone may increase the rate at which fanfold material 50 can be stacked. As the rotatable member 20 rotates about its axis 40, each of the head pieces 30*a*-30*d* may become engaged with and subsequently disengaged from a portion of the length of fanfold material 50.

As discussed elsewhere herein, a control system can be used to activate/deactivate the vacuum and/or blower settings of the head pieces 30*a*-30*d*. For instance, vacuum settings can be activated/deactivated on one or more of the head pieces 30*a*-30*d* when the one or more head pieces 30*a*-30*d* are positioned between certain locations about axis 40. Likewise, blower settings may be activated/deactivated on one or more of the head pieces 30*a*-30*d* when the one or more head pieces 30*a*-30*d* are positioned between certain locations about axis 40.

Figure 1A:
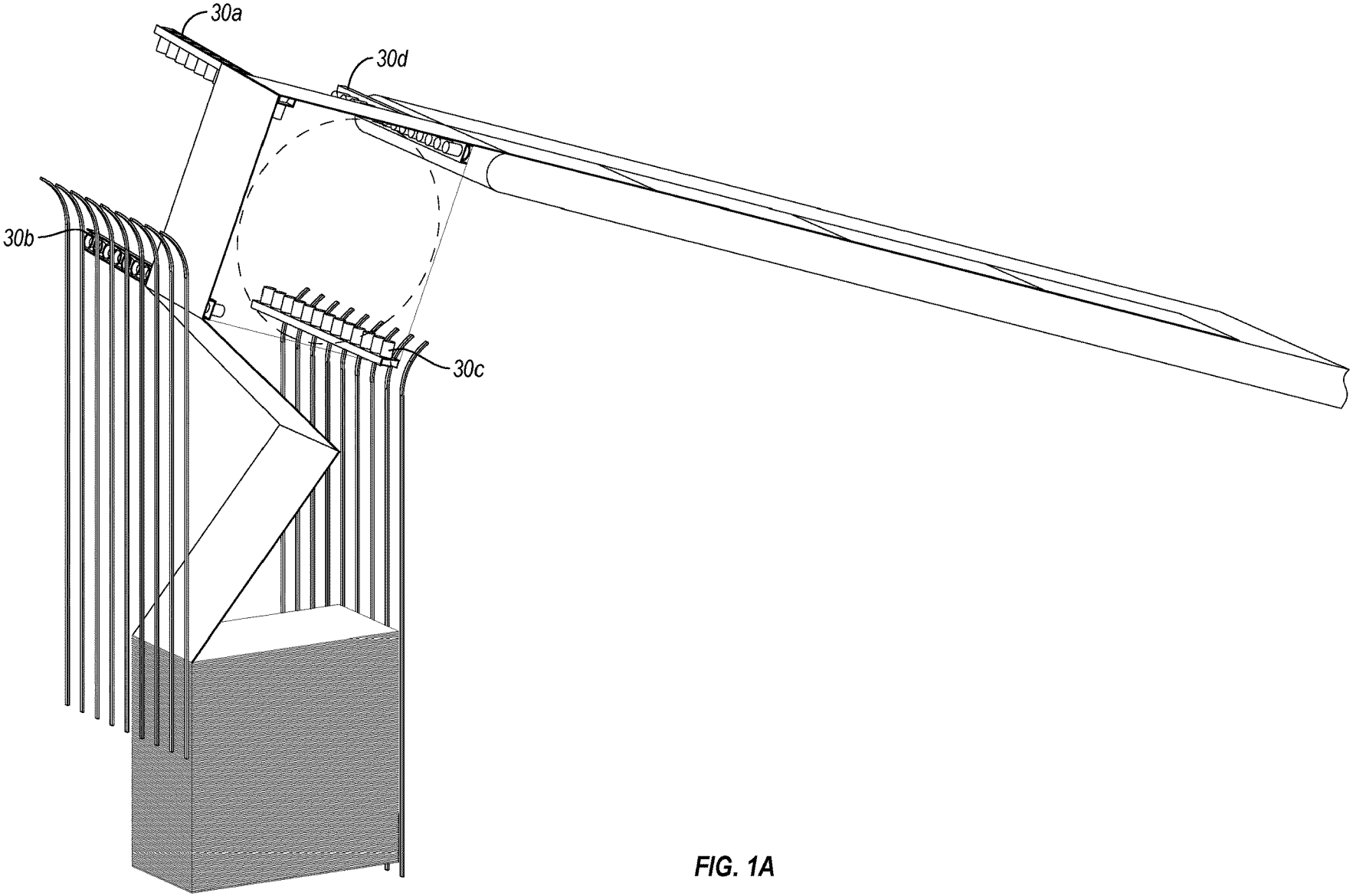
FIGS. 1A-1O illustrate the vacuum wheel fanfold stacker of FIG. 1 in various operational positions while stacking fanfold material.
Figure 1B:
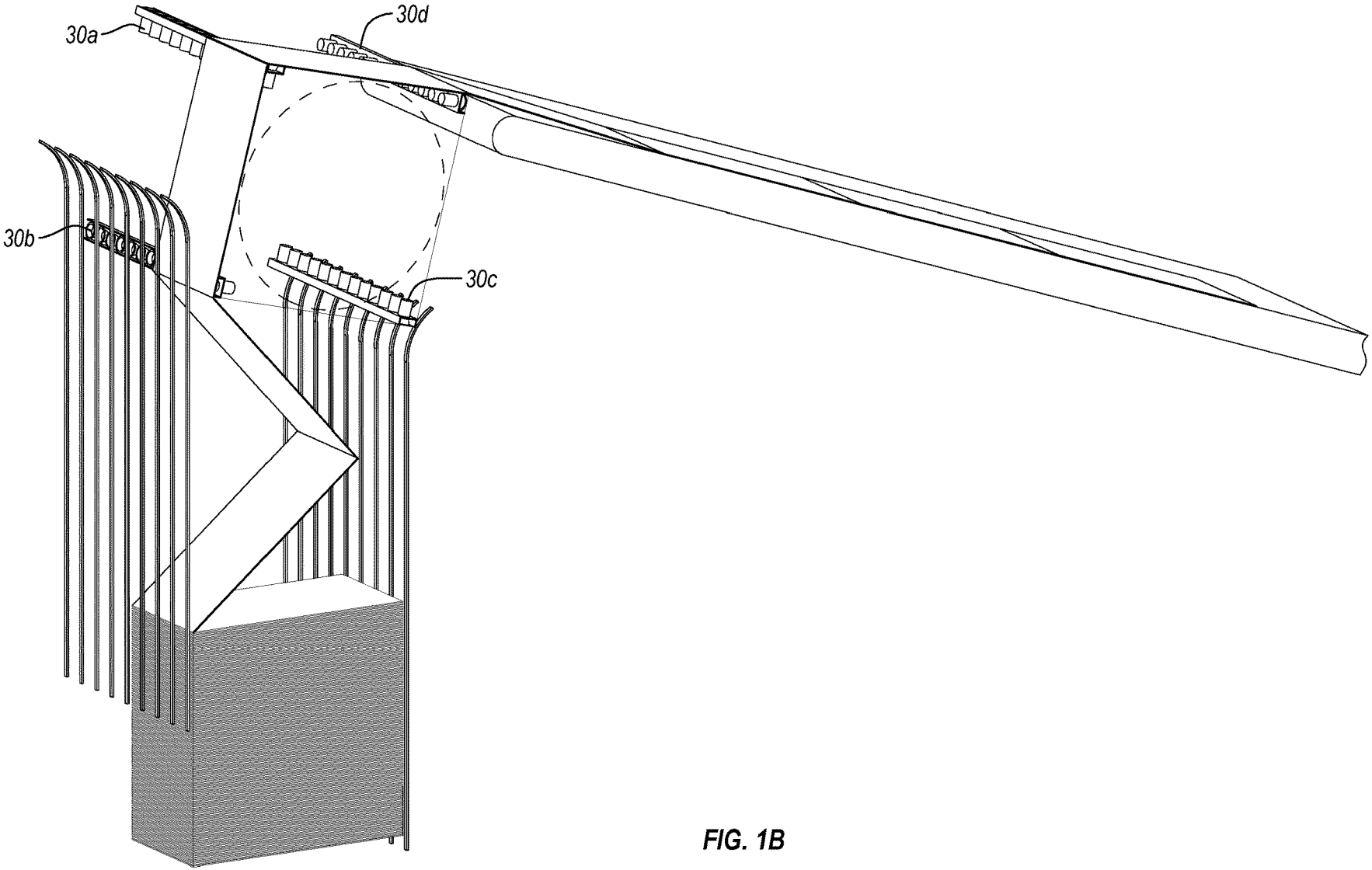
Figure 1C:
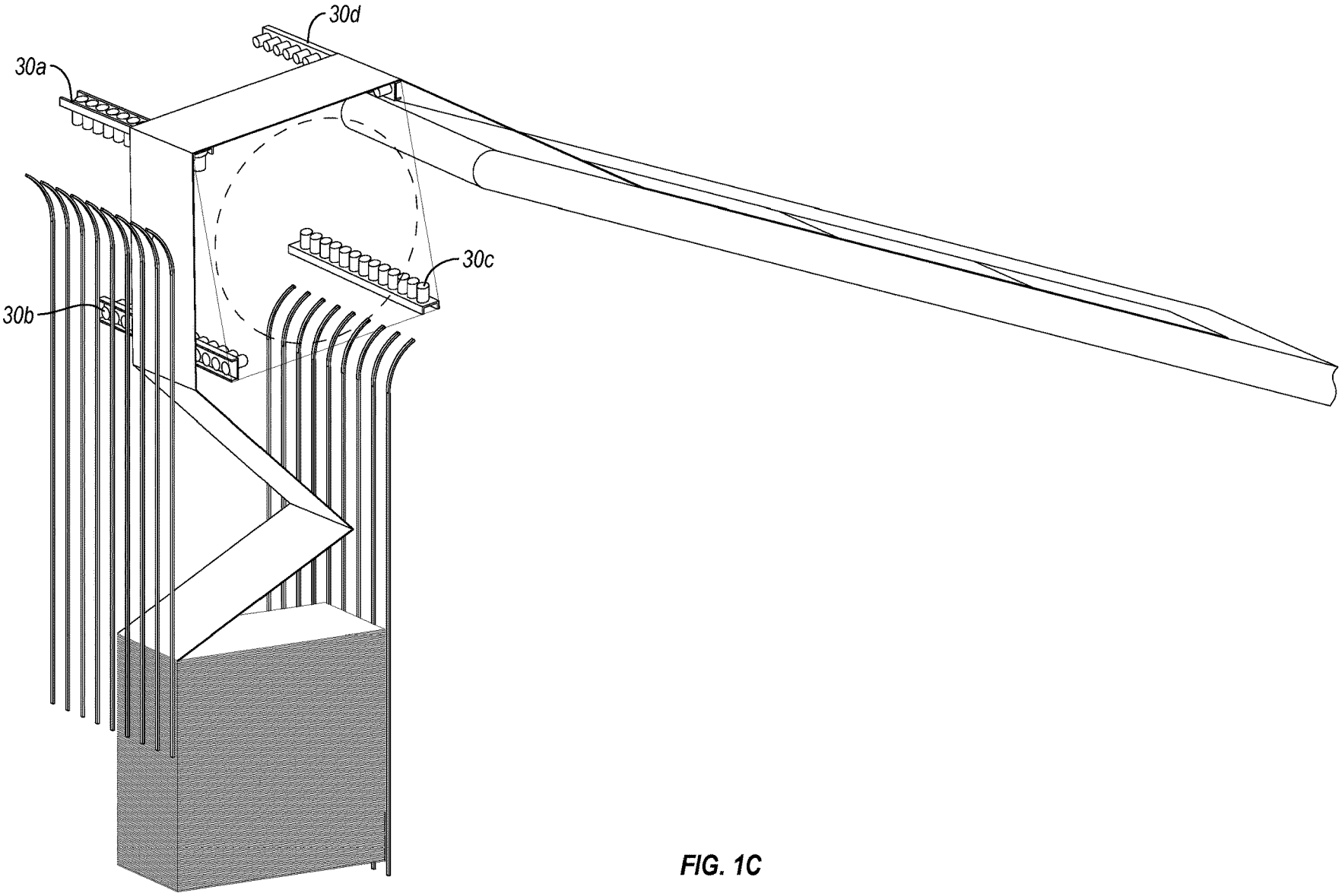
Figure 1D:
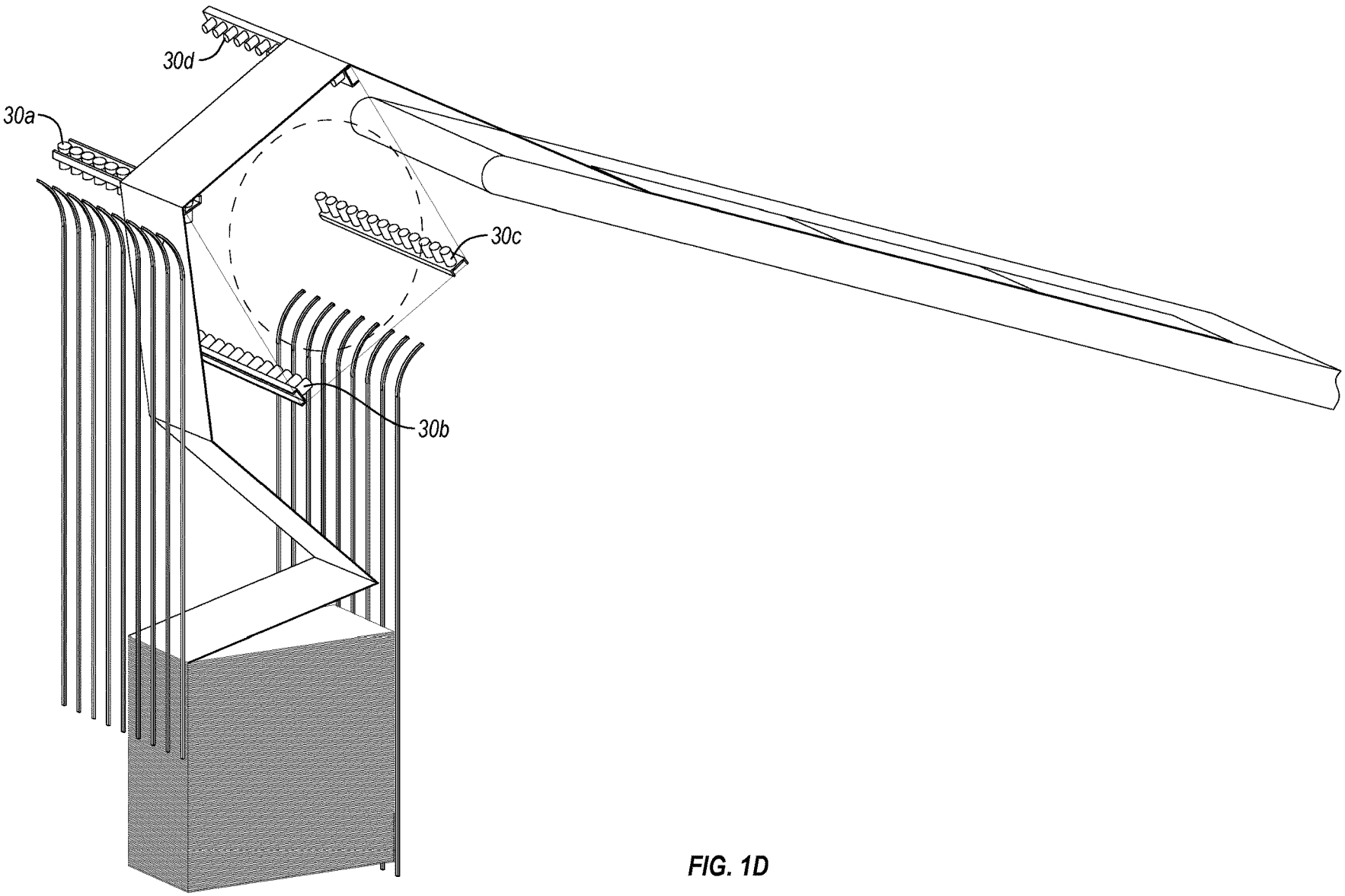
Figure 1E:
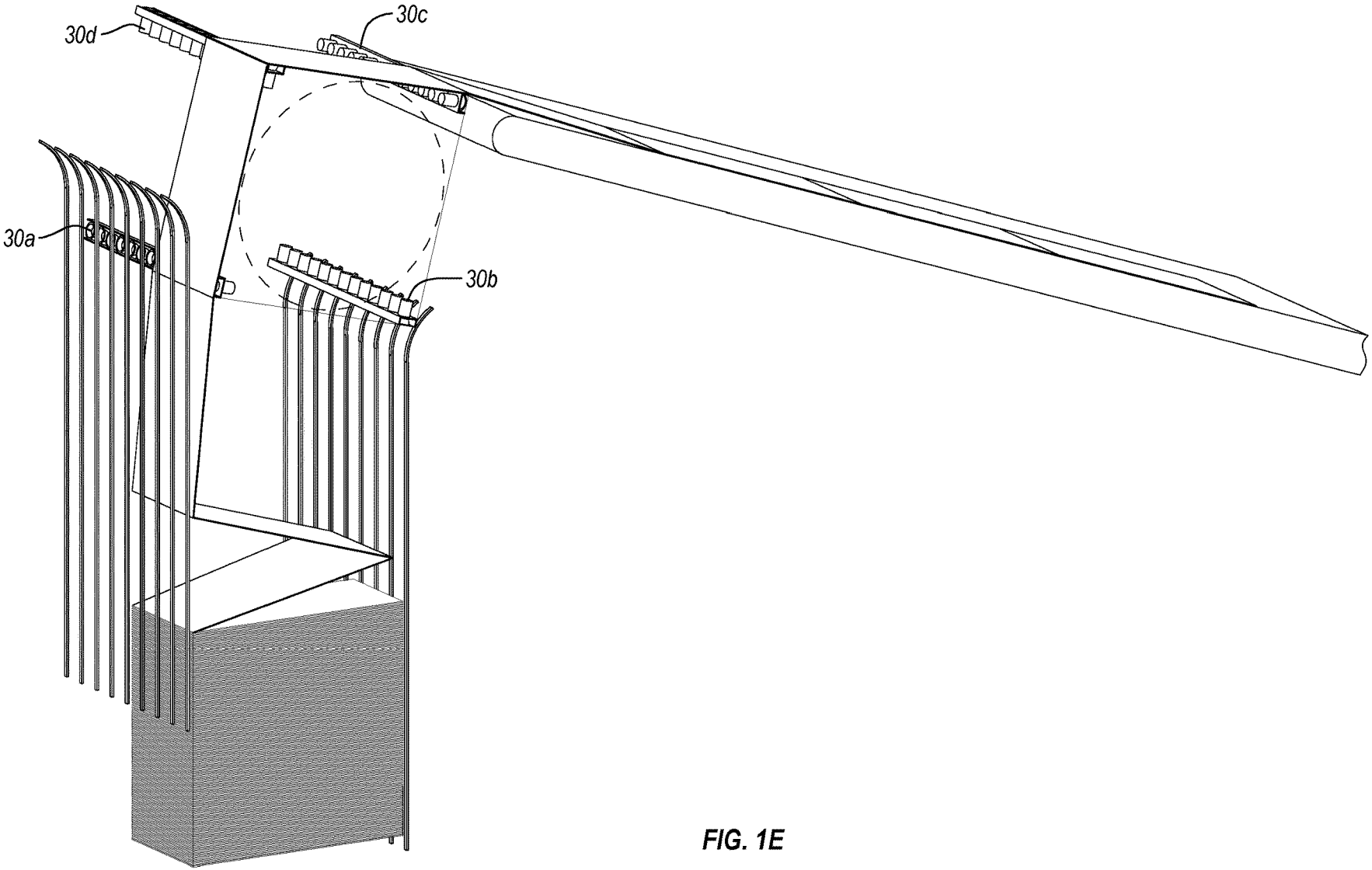
Figure 1F:
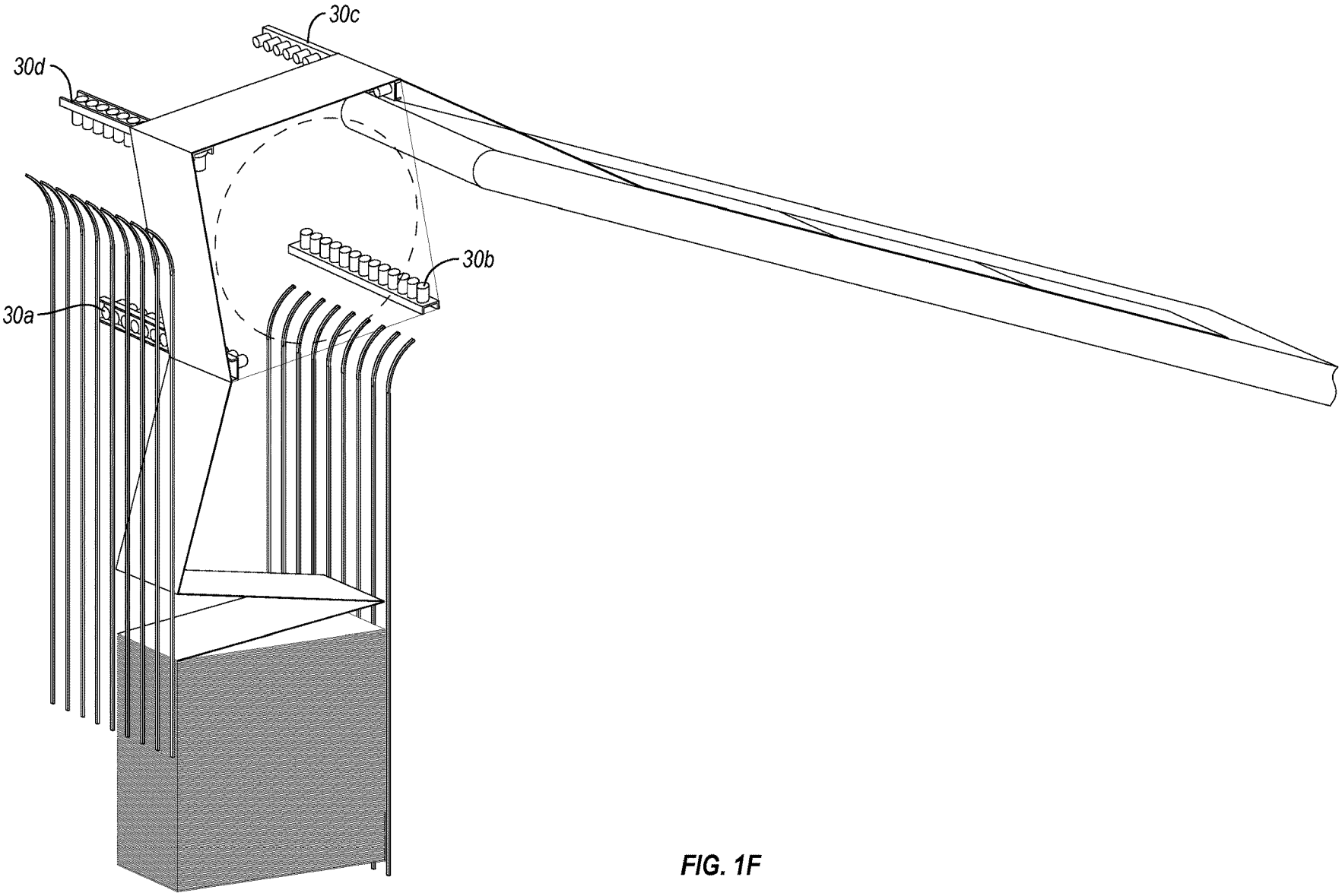

By way of example, a vacuum setting on the head piece 30*a* may be activated when the head piece 30*a* is in the positions shown in FIGS. 1A-1F or when the head piece 30*a* moves through an arc between the positions shown in FIGS. 1A and 1F. Similarly, a vacuum setting on the head piece 30*b* may be activated when the head piece 30*b* is in the positions shown in FIGS. 1A-1B and 1L-1O or when the head piece 30*b* moves through an arc between the positions shown in FIGS. 1L and 1B. A vacuum setting on the head piece 30*c* may be activated when the head piece 30*c* is in the positions shown in FIGS. 1H-1M or when the head piece 30C moves through an arc between the positions shown in FIGS. 1H and 1M. A vacuum setting on the head piece 30*d* may be activated when the head piece 30*d* is in the positions shown in FIGS. 1E-1I or when the head piece 30*d* moves through an arc between the positions shown in FIGS. 1E and 1I.

Figure 1G:
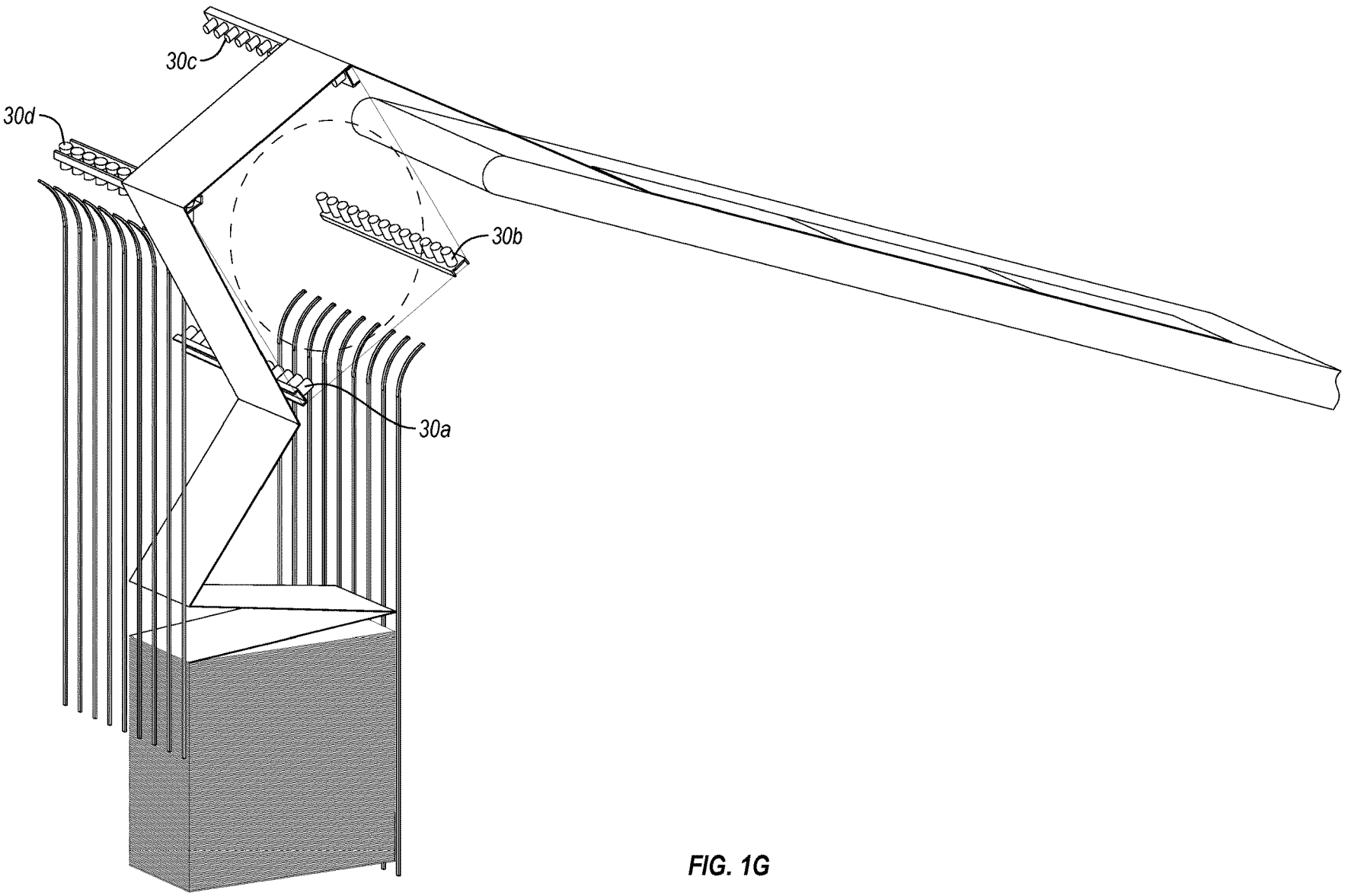
Figure 1H:
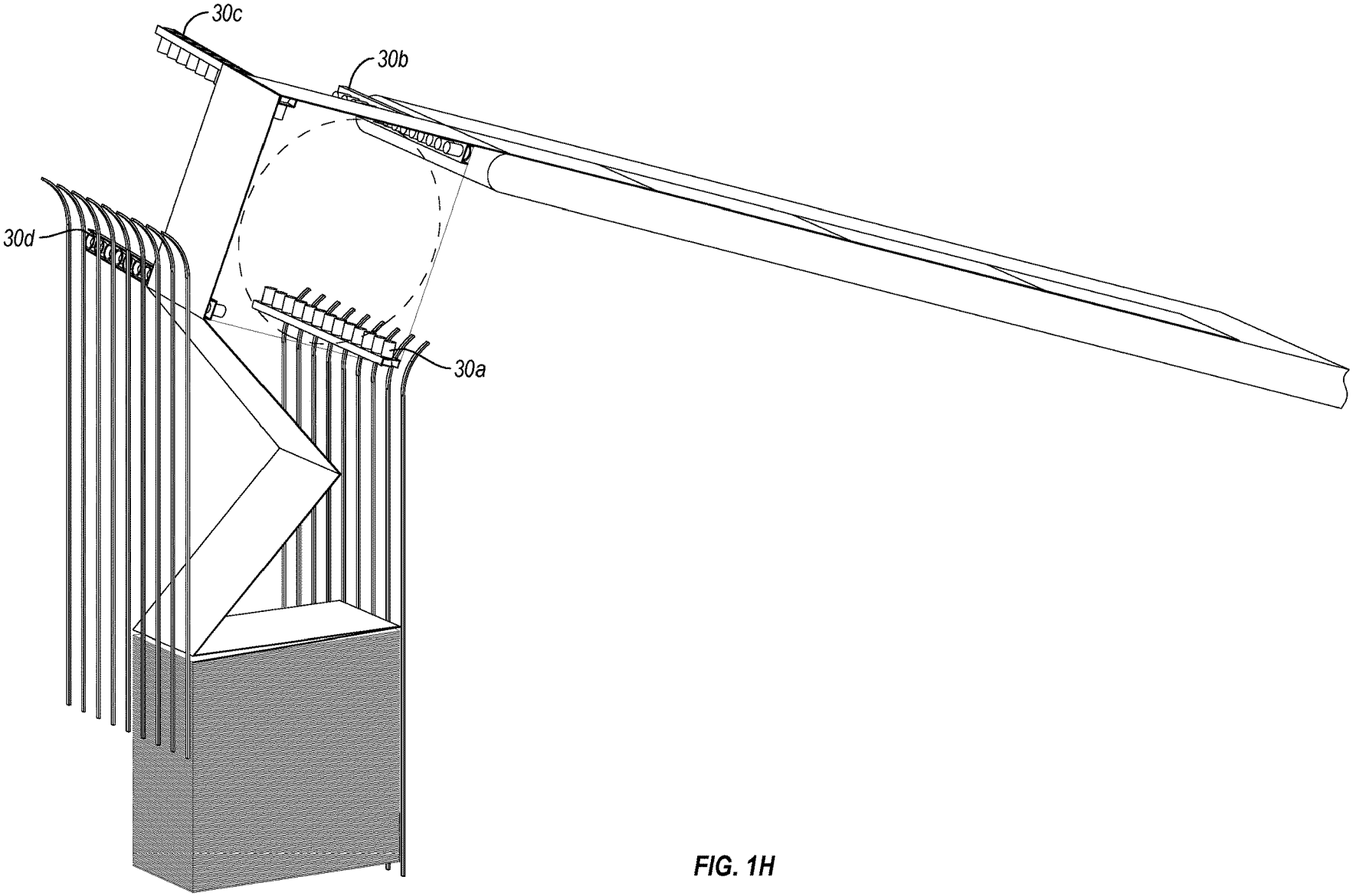
Figure 1I:
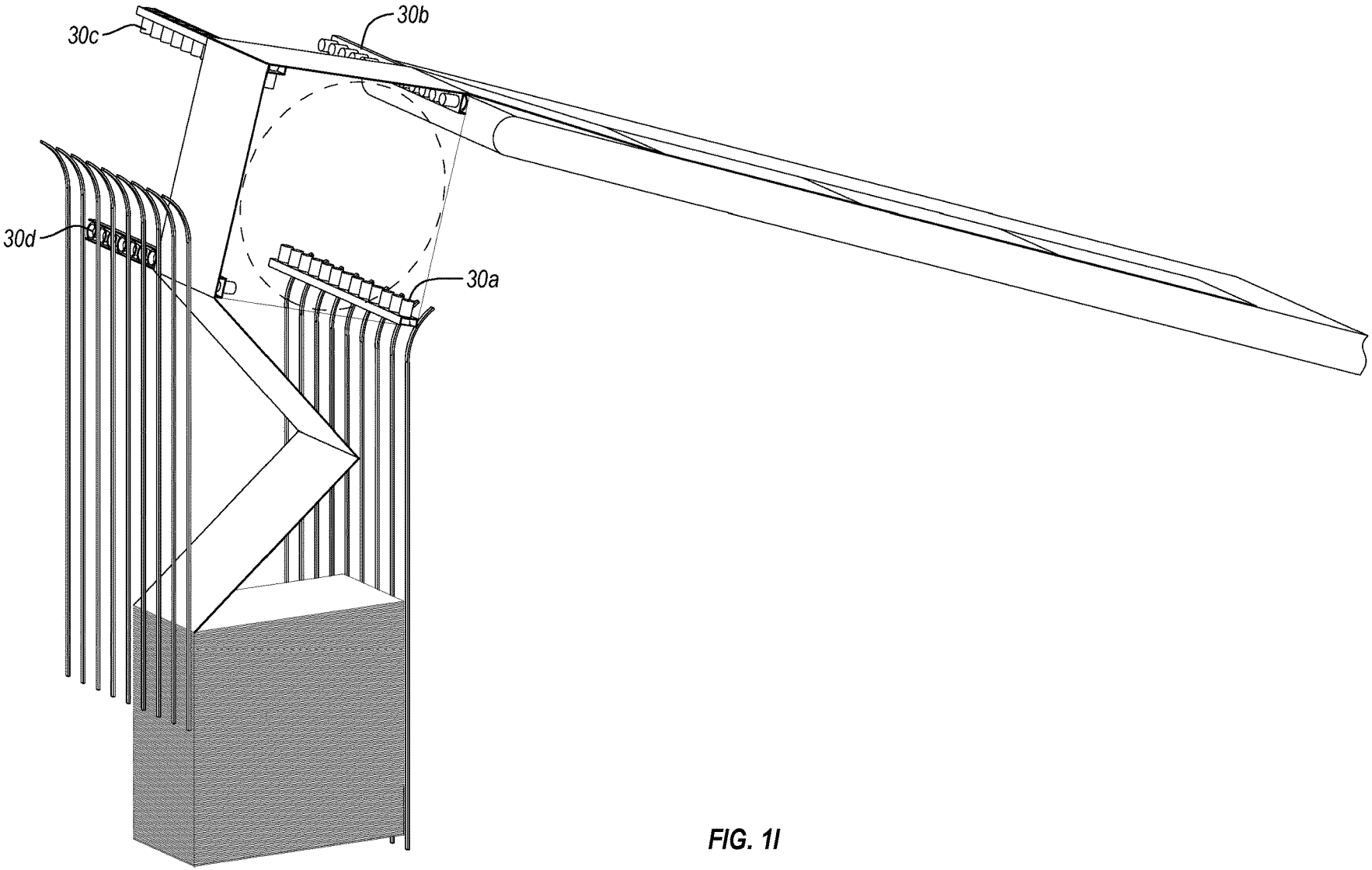
Figure 1J:
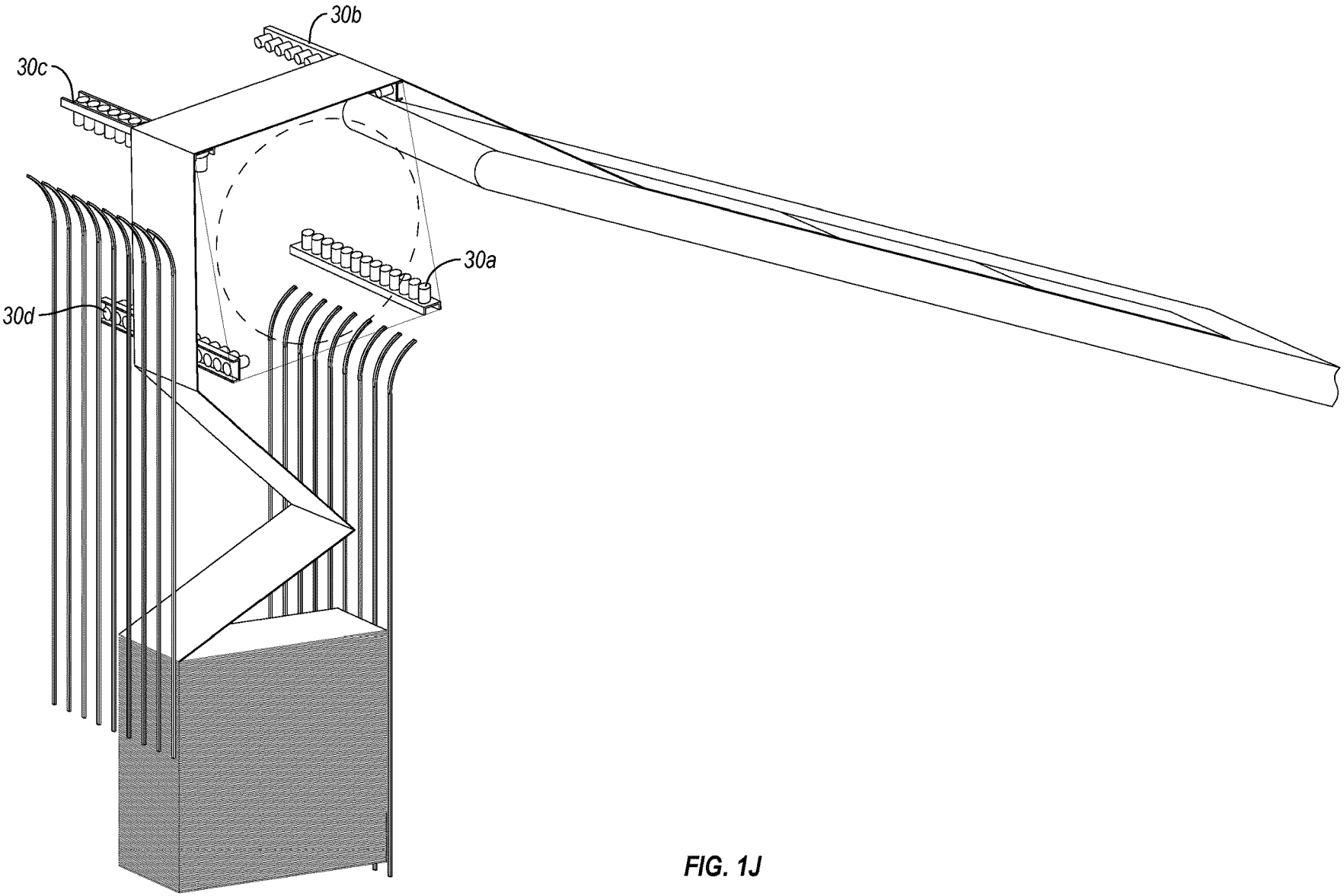
Figure 1K:
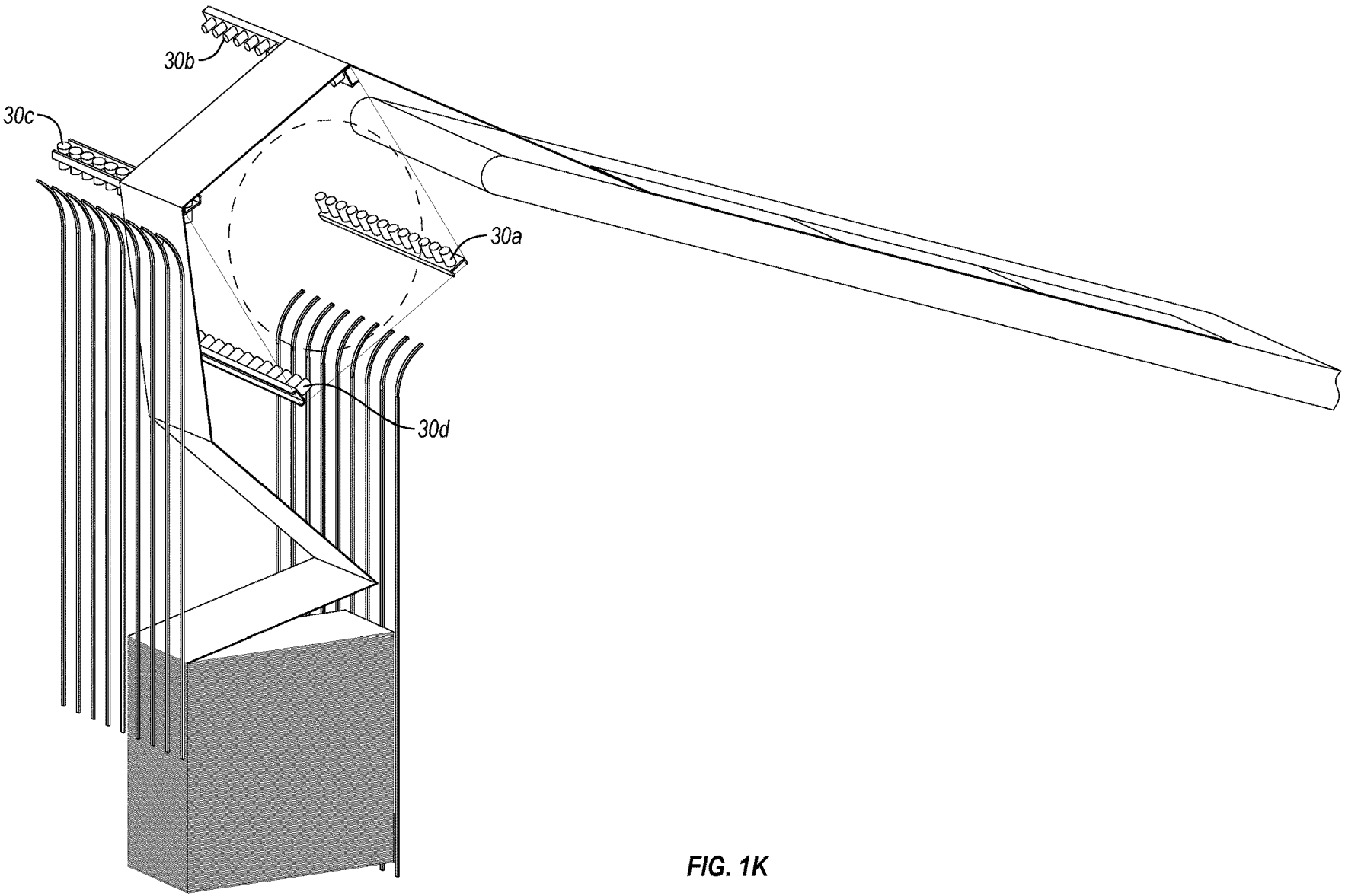
Figure 1L:
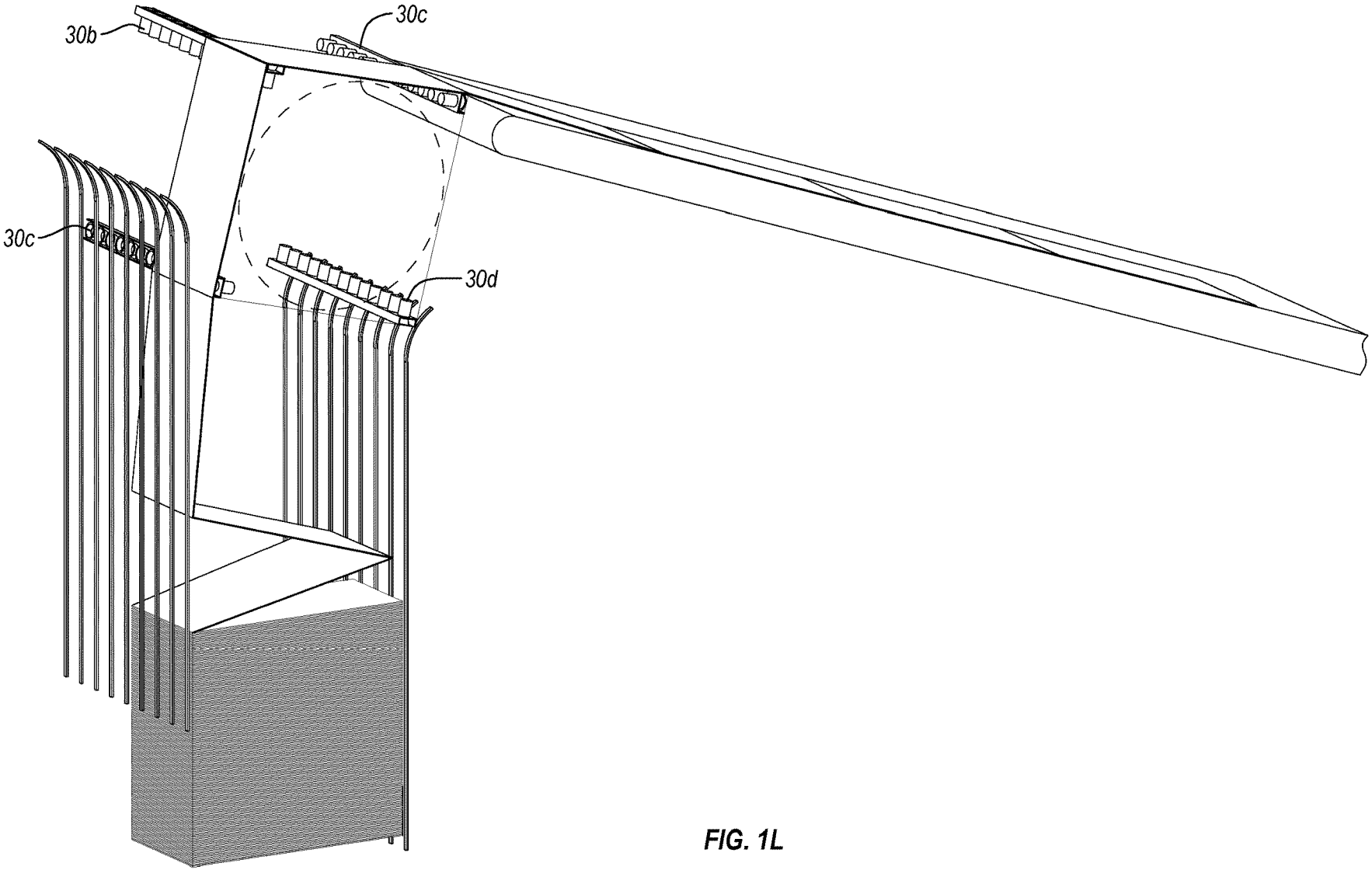
Figure 1M:
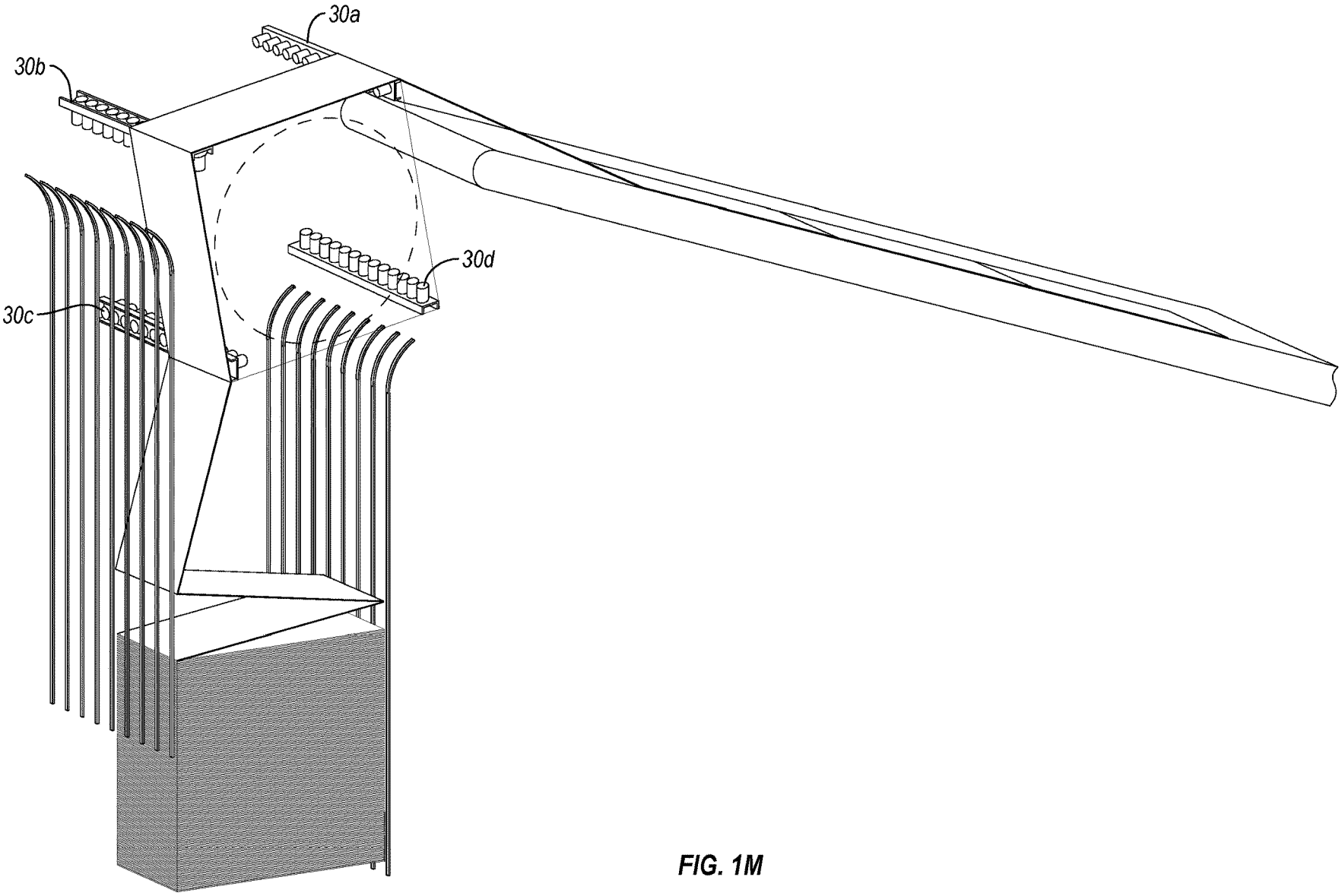
Figure 1N:
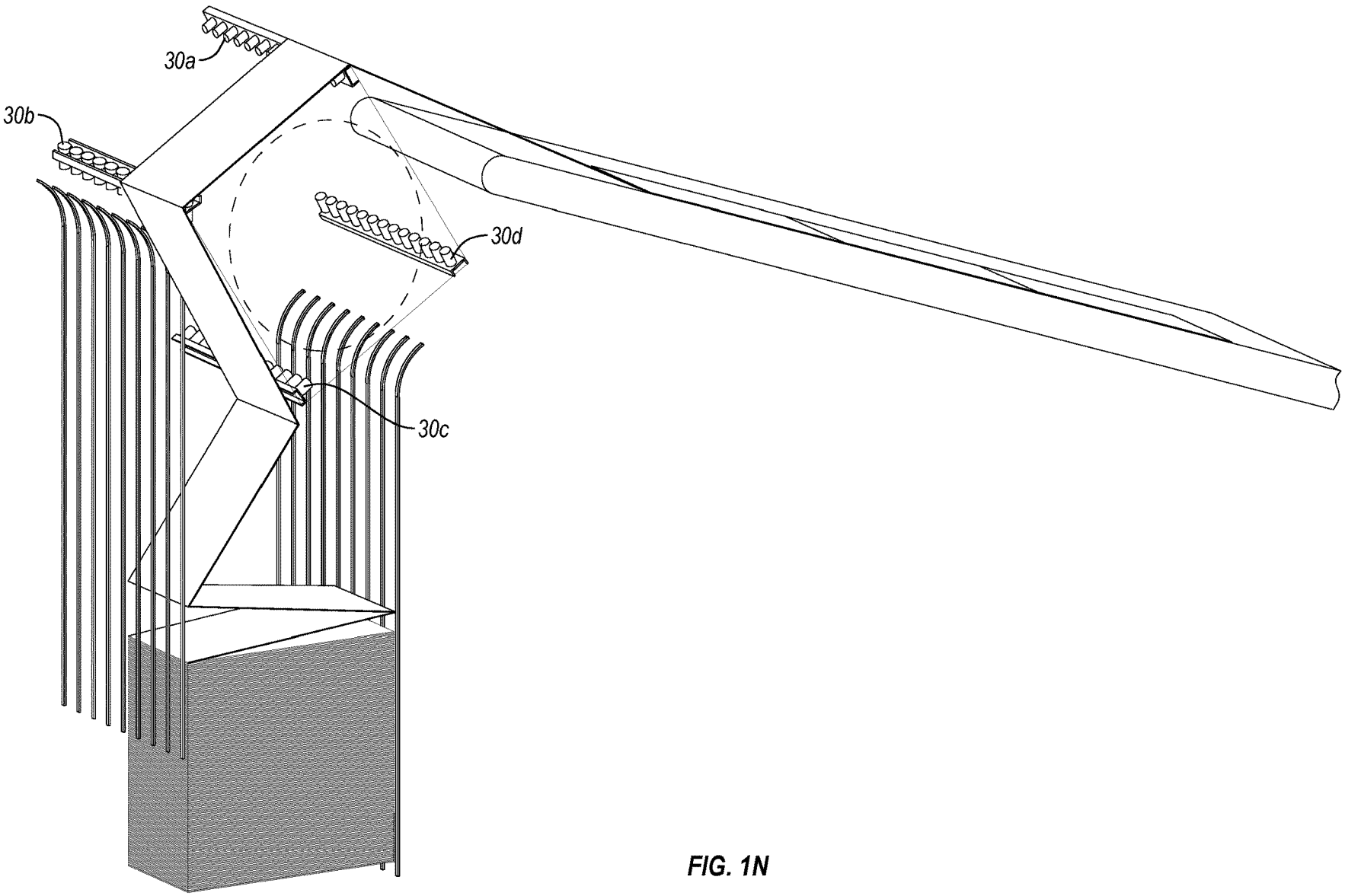
Figure 10:
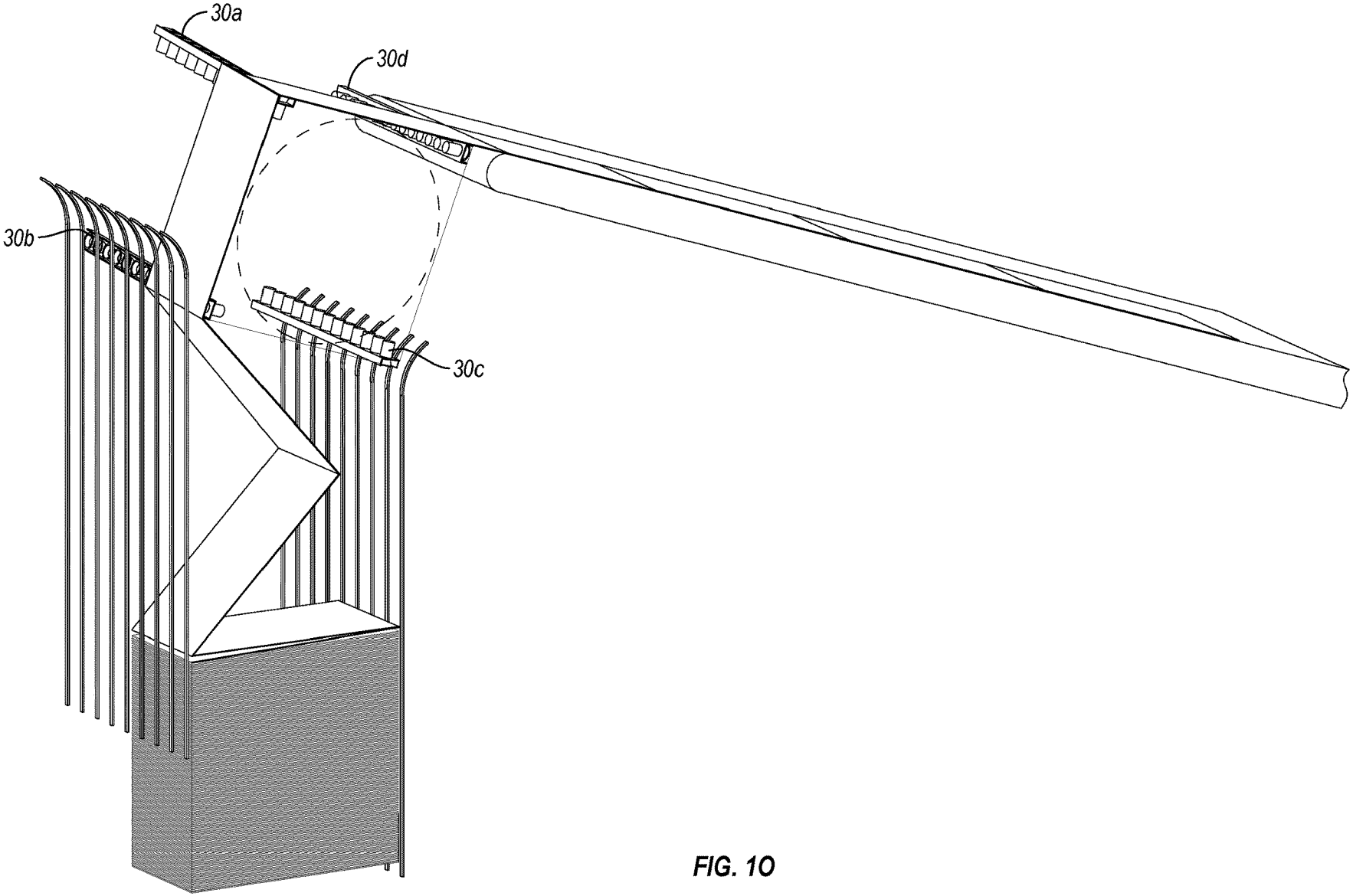

As with the vacuum settings, a blower setting on the head piece 30*a* may be activated when the head piece 30*a* is in the positions shown in FIGS. 1G-1H or when the head piece 30*a* moves through an arc between the positions shown in FIGS. 1G and 1H. Likewise, a blower setting on the head piece 30*b* may be activated when the head piece 30*b* is in the positions shown in FIGS. 1C-1D or when the head piece 30*b* moves through an arc between the positions shown in FIGS. 1C and 1D. A blower setting on the head piece 30*c* may be activated when the head piece 30*c* is in the positions shown in FIGS. 1N-1A or when the head piece 30*c* moves through an arc between the positions shown in FIGS. 1N and 1A. A blower setting on the head piece 30*d* may be activated when the head piece 30*d* is in the positions shown in FIGS. 1J-1K or when the head piece 30*d* moves through an arc between the positions shown in FIGS. 1J and 1K.

In additional to the vacuum and blower settings, the control systems may deactivate both the vacuum and blower settings, providing the head pieces with an "off setting". The off settings on the head pieces 30*a*-30*d* made be used during a portion of the rotation of the head pieces 30*a*-30*d* about axis 40. For instance, the vacuum and blower settings for head piece 30*a* may be deactivated when the head piece 30*a* is in the positions shown in FIGS. 1I-1N or when the head piece 30*a* moves through an arc between the positions shown in FIGS. 1I and 1N. Similarly, the vacuum and blower settings for head piece 30*b* may be deactivated when the head piece 30*b* is in the positions shown in FIGS. 1E-1K or when the head piece 30*b* moves through an arc between the positions shown in FIGS. 1E and 1K. The vacuum and blower settings for head piece 30*c* may be deactivated when the head piece 30*c* is in the positions shown in FIGS. 1B-1G or when the head piece 30*c* moves through an arc between the positions shown in FIGS. 1B and 1G. The vacuum and blower settings for head piece 30*d* may be deactivated when the head piece 30*d* is in the positions shown in FIGS. 1A-1D and 1L-1O or when the head piece 30*d* moves through an arc between the positions shown in FIGS. 1L and 1D.

Thus, the vacuum, blower, and off settings of each of the head pieces 30*a*-30*d* can be controlled and changed as the head pieces 30*a*-30*d* rotate about axis 40. More specifically, each of the head pieces 30*a*-30*d* can cycle through the vacuum, blower, and off settings as the head pieces 30*a*-30*d* rotate about axis 40. For instance, the head piece 30*a* may have: (i) a vacuum setting activated through a first portion of the travel path about axis 40; (ii) a blower setting activated through a second portion of the travel path about axis 40; and (ii) an off setting activated through a third portion of the travel path about axis 40.

As can be seen in FIGS. 1A-1O, while the total travel path length may be the same for each head piece, the lengths of the first, second and third portions of the travel path may be different for different head pieces. For instance, the first portion of the travel path for the head pieces 30*a*, 30*c* may be longer than the first portion of the travel path for the head pieces 30*b*, 30*d*. In other words, the vacuum settings for the head pieces 30*a*, 30*c* may be activated for a longer time than the vacuum settings for the head pieces 30*b*, 30*d*. Similarly, the travel lengths and/or activation times for the blower and off settings for the heads 30*a*, 30*c* may also differ from the travel lengths and/or activation times for the blower and off settings for the heads 30*b*, 30*d*. It will also be understood that the travel lengths and/or activation times for each of the settings for each of the head pieces 30*a*-30*d* may differ from one another or may be the same as one another.

The stack of fanfold material 70 may be formed of a plurality of different layers of fanfold material 50. For instance, according to one example embodiment, a score line 60 may be formed at the opposing edges of each layer of fanfold 50 in the stack of fanfold material 70; score lines 60 can demark the transition from one layer to the next. Each layer may be generally positioned in the stack 70 such that it is vertically higher than a prior layer, and vertically lower relative to a subsequent layer. It will be appreciated that the stack 70 may be arranged in different orientations, such as horizontal or angled. For instance, in a horizontally oriented stack, each layer may be generally positioned horizontally to one side of another layer. In an angled stack, each layer may be generally positioned both horizontally and vertically relative to an adjacent layer.

A particular aspect of the score lines 60 formed in fanfold material 50 is that they allow fanfold material 50 to fold over itself to form the multiple layers of the fanfold stack 70. Thus, when viewing a fanfold stack (e.g., stack 70) from a side or overhead view, score lines can be at the edges of the fanfold stack.

In this example embodiment, the fanfold stack 70 is formed in hopper 90. The hopper 90 includes a plurality of vertical members 92 that are separated from one another. Separating the plurality of vertical members 92 may, for example, permit the fanfold material 50 to stack more efficiently because air that may otherwise become trapped between layers can readily escape between the vertical members 92. Each of the plurality of vertical members 92 may also include a curved upper portion 94 such that the rotatable member 20 is able to rotate substantially within the confines of the hopper without getting bound up on the vertical members 92. The curved upper portions 94 may also assist with directing the fanfold material 50 into the hopper 90.

The electronic control system 100 may be linked to one or both of conveyor 80 or the rotatable member 20 via communication lines 102 and 104, respectively. The electronic control system 100 may, for example, set and/or adjust the speed of one or both of the conveyor 80 or the rotatable member 20 such that fanfold material 50 is fed to the rotatable member 20 at a rate that allows the fanfold material 50 to be cleanly and efficiently stacked. In addition, the electronic control system 100 may be linked to a number of other control/feedback devices (not shown) such as speed sensors, electronic eyes or cameras, and the like that allow fanfold material 50 to be fed to the rotatable member 20 such that the creases 60 are correctly positioned relative to the head pieces 30*a*-30*d* and that the fanfold material 50 is cleanly and efficiently stacked.

Referring now to FIG. 2, a rotatable member 20 having a pneumatic control system 200 linked thereto is illustrated in schematic form. The pneumatic control system 200 may be an electronic control system that controls the timing and application of vacuum and/or compressed air or it may be linked to the electronic control system 100. The pneumatic control system 200 may also include a vacuum source and/or a compressed air source (shown collectively at 205) that is linked to each of the head pieces 30*a*-30*d*. Accordingly, the pneumatic control system 200 and/or the electronic control system 100 may control the activation of the vacuum, blower, and/or off settings (as described elsewhere herein) for the head pieces 30*a*-30*d*.

In the illustrated embodiment, the vacuum source/compressed air source 205 is connected to a manifold 230 that distributes vacuum lines 210 and compressed air lines 220 to each of the head pieces 30*a*-30*d*. In one embodiment, the manifold 230 may be a stationary connection that maintains pneumatic connection between the vacuum source/compressed air source 205 and each of the head pieces 30*a*-30*d* as the rotatable member 20 rotates about axis 40. Such devices are known to those having skill in the pneumatic arts. For example, similar manifolds or one type of manifold that can be employed is the so-called "on the fly" tire inflation/deflation systems that are equipped on some automobiles.

Referring now to FIG. 3, perspective views of an expandable rotatable member 300 are shown in first and second configurations. The expandable nature of the rotatable member 300 enables the rotatable member 300 to accommodate fanfold materials having different inter-score distances. In other words, the rotatable member 300 can be selectively adjusted, resized, or reconfigured so that the distance between adjacent head pieces 30*a*-30*d* generally corresponds to the inter-score distance of a desired fanfold material.

For instance, FIG. 3 illustrates the rotatable member 300 in a first configuration in which there is a distance $d'_1$ between adjacent head pieces 30*a*-30*d*. The distance $d'_1$ between adjacent head pieces 30*a*-30*d* generally corresponds to the inter-score distances $d_1$ of the fanfold material 350. As a result, the head pieces 30*a*-30*d* engage the fanfold material 350 near the fanfold creases to stack the fanfold material 350 into a stack, as discussed above.

If a fanfold material with a different inter-score distance is sought to be used with the rotatable member 300, the rotatable member 300 can be selectively adjusted, resized, or reconfigured to accommodate the different inter-score distance of the different fanfold material. For instance, as shown in FIG. 3, the rotatable member 300 may be selectively adjusted, resized, or reconfigured so that a new distance $d'_2$ between adjacent head pieces 30*a*-30*d* generally corresponds to the inter-score distances $d_2$ of the fanfold material 355.

The rotatable member 300 may be selectively adjusted, resized, or reconfigured in a variety of ways. For instance, the frame 22' of the rotatable member 300 may be formed of expandable/contractable components. By way of example, each side of the frame 22' may be formed of telescoping rods or tubes that allow for the length of each side of the frame 22' to be selectively increased or decreased so as to move the head pieces 30*a*-30*d* further apart or closer together. In other embodiments, the head pieces 30*a*-30*d* and/or parts of the frame 22' may be pivotally mounted such that the head pieces 30*a*-30*d* and/or parts of the frame 22' may be pivoted closer to or further from the rotational axis 40 of the rotatable member 300. When the head pieces 30*a*-30*d* and/or parts of the frame 22' are pivoted away from the rotational axis 40, the length of each side of the rotatable member 300, and thus the distance between adjacent head pieces 30*a*-30*d*, increases. In contrast, when the head pieces 30*a*-30*d* and/or parts of the frame 22' are pivoted toward the rotational axis 40, the length of each side of the rotatable member 300, and thus the distance between adjacent head pieces 30*a*-30*d*, decreases.

The rotatable member 300 may be selectively adjusted, resized, or reconfigured in a reversible manner. That is, the size of the rotatable member 300 may be selectively increased and later selectively decreased, and vice versa. Furthermore, while FIG. 3 only illustrates the rotatable member 300 in two size configurations, this is merely for convenience. An expandable rotatable member may be configured to be expandable/contractable to substantially any size to accommodate substantially any size of fanfold material. Alternatively, a fanfold stacker system may be equipped with multiple rotatable members having a variety of sizes to accommodate different sizes of fanfold material.

Anyone of the fanfold stacker system embodiments described herein may be employed in a method for stacking fanfold material. For example, FIGS. 1A-1O illustrate a number of views of a method for stacking fanfold material using a system for folding and stacking fanfold material as illustrated in FIG. 1.

A method for folding and stacking fanfold material may include (i) delivering a first end of a length of a fanfold material to a rotatable member having at least two head pieces disposed on the rotatable member and which are circumferentially offset from one another, (ii) rotating the rotatable member about a central axis while simultaneously continuing to deliver the fanfold material to the rotatable member, (iii) engaging a portion of the length of scored or creased fanfold material by vacuum with a first head piece so as to rotate the portion of the length of scored or creased fanfold material around the central axis, and (iv) deactivating the vacuum and/or switching the first head piece to a blower setting at a predetermined position around the axis so as to blow the portion of the length of scored or creased fanfold material away from the rotatable member so as to form a stack of folded fanfold material. In one embodiment, the method further includes (v) stacking the stack of folded fanfold material in a hopper positioned adjacent to the rotatable member. The blower setting may be able push the fanfold material down onto the stack more quickly than simply allowing the fanfold to descend by gravity alone, thereby increasing the rate at which fanfold can be stacked.

In one embodiment, the fanfold material includes a number of substantially evenly spaced score lines or crease lines positioned on the fanfold material substantially perpendicular to a long edge of the fanfold material. In other embodiments, the fanfold material is formed without the score or crease lines. In such embodiments, the fanfold stacker may create creases or folds in the fanfold material as the fanfold stacker rotates the fanfold material thereabout, as described herein. More specifically, the rotation of the fanfold material may force-fold the material, thereby creating regularly spaced creases that allow the material to be stacked as described herein.

In one embodiment, the method further includes detecting a position of one or more of the score lines or crease lines in the length of the fanfold material, and updating the relative timing of one or more of steps (i)-(iv) as a function of the position of the score lines or crease lines in the length of the fanfold material.

In one embodiment of the method, a first head piece engages the fanfold material adjacent to a first score line or crease line and a second head piece engages the fan fold material adjacent to a second score line or crease line.

In one embodiment, the method further includes delivering the first end of the length of a fanfold material using a conveyor positioned adjacent to the rotatable member.

In one embodiment, the stack of folded fanfold material is stacked in a zig-zag pattern such that, when viewed from the side of the stack, there are left folds and right folds. In one embodiment, switching the first head piece to the blower setting occurs at a first predetermined position if forming a left fold and at a second predetermined position if forming a right fold. Compare, for example, FIGS. 1C and 1G. FIG. 1C shows a left fold being formed (adjacent the head piece 30*b*). In such a case, the head piece releases the fanfold material when the fanfold material is hanging about vertically (or is oriented about perpendicular to the end of the stack). In contrast, FIG. 1G shows a right fold being formed (adjacent the head piece 30*a*). In the case of a right fold, the head piece engages with the fanfold material relatively longer and releases the fanfold material when the fanfold material is rotated about the rotatable member until the fanfold is hanging well past vertical (or is oriented at an acute angle relative to the end of the stack). Such a system may, for example, allow the fanfold stacker system to direct the fanfold so that it is efficiently and regularly folded.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for folding and stacking fanfold material, comprising:

a rotatable member; and at least two head pieces disposed on the rotatable member, the at least two head pieces being circumferentially offset from one another on the rotatable member, the at least two head pieces comprising a first head piece and a second head piece, the first head piece and the second head piece each having a first vacuum setting configured to engage a portion of a length of the fanfold material so as to rotate the fanfold material about the rotatable member to change a direction of movement of the fanfold material, and the first head piece and the second head piece each having a second blower setting configured to blow the portion of the length of the fanfold material away from the rotatable member, wherein:

the first vacuum setting of the first head piece is activated during a first portion of a travel path around the rotatable member until the first head piece is rotated to a first predetermined position of the first head piece about the rotatable member;

the second blower setting of the first head piece is activated during a second portion of the travel path around rotatable member until the first head piece is rotated to a second predetermined position of the first head piece about the rotatable member;

the first vacuum setting of the second head piece is activated during a first portion of a travel path around the rotatable member until the second head piece is rotated to a first predetermined position of the second head piece about the rotatable member;

the second blower setting of the second head piece is activated during a second portion of the travel path around rotatable member until the second head piece is rotated to a second predetermined position of the second head piece about the rotatable member; and the second portion of the travel path of the first head piece being circumferentially offset from the second portion of the travel path of the second head piece.

2. The system of claim 1, further comprising a conveyor positioned adjacent to the rotatable member to deliver a length of scored or creased fanfold material to the rotatable member.

3. The system of claim 2, further comprising a hopper positioned adjacent to the rotatable member and opposite the conveyor, wherein the hopper is configured for receiving folded fanfold material delivered by the rotatable member.

4. The system of claim 3, wherein the hopper automatically maintains a general level of an upper-most layer of the stack of folded fanfold material, wherein the hopper automatically maintains the general level of the upper-most layer of the stack of folded fanfold material by lowering the stack of folded fanfold material when new layers are added to the stack.

5. The system of claim 1, wherein the rotatable member includes at least four circumferentially offset head pieces.

6. The system of claim 5, wherein the head pieces are substantially equidistant from one another.

7. The system of claim 1, wherein each head piece is coupled to a pneumatic control system configured to switch each head piece from the first vacuum setting to the second blower setting.

8. The system of claim 1, wherein the first vacuum setting of each of the at least two head pieces alternately remain activated until the fanfold material is rotated to the first and second predetermined positions so as to alternately make left and right folds in the fanfold material as the fanfold material is stacked.

9. The system of claim 1, wherein a height of the rotatable member automatically adjusts to maintain the general level of an upper-most layer of the stack of folded fanfold material.

10. A method for folding and stacking fanfold material, the method comprising:

rotating a rotatable member about an axis, the rotatable member having a first head piece and a second head piece disposed thereon and that are circumferentially offset from one another about the rotatable member;

delivering fanfold material to the rotatable member;

cycling the first head piece through a first vacuum setting and a second blower setting as the first head piece moves about the axis, such that the first head piece (i) creates a vacuum engagement with the fanfold material during a first portion of a travel path around the axis, and (ii) blows the fanfold material away from the rotatable member during a second portion of the travel path around the axis; and cycling the second head piece through a first vacuum setting and a second blower setting as the second head piece moves about the axis, such that the second head piece (i) creates a vacuum engagement with the fanfold material during a first portion of the travel path around the axis, and (ii) blows the fanfold material away from the rotatable member during a second portion of the travel path around the axis, wherein the second portion of the travel path of the second head piece is circumferentially offset from the second portion of the travel path of the first head piece.

11. The method of claim 10, wherein the first vacuum settings of the first and second head pieces are activated for different lengths of time.

12. The method of claim 10, wherein the second blower settings of the first and second head pieces are activated for different lengths of time.

13. The method of claim 10, wherein the first portion of the travel path of the first head piece is at least partially offset from the first portion of the travel path of the second head piece.

14. The method of claim 10, wherein cycling the first head piece through the first vacuum setting and the second blower setting comprises activating the first vacuum setting for a first time frame and activating the second blower setting for a second time frame.

15. The method of claim 14, wherein the first time frame and the second time frame do not overlap one another.

16. The method of claim 14, wherein cycling the second head piece through the first vacuum setting and the second blower setting comprises activating the first vacuum setting for a first time frame and activating the second blower setting for a second time frame.

17. The method of claim 15, wherein the first time frame for the first head piece and the first time frame for the second head piece have different lengths of time.

18. The method of claim 15, wherein the second time frame for the first head piece and the second time frame for the second head piece have different lengths of time.

19. The method of claim 10, further comprising cycling the first head piece through a third off setting during a third portion of the travel path around the axis.

20. The method of claim 10, further comprising cycling the second head piece through a third off setting during a third portion of the travel path around the axis.

* * * * *